US007172464B1

(12) United States Patent
Lee

(10) Patent No.: US 7,172,464 B1
(45) Date of Patent: Feb. 6, 2007

(54) CARD ADAPTER

(76) Inventor: Yun-Hsiu Lee, 15F., No. 88, Hsing-De Rd., San Chung, Taipei Hsien (TW)

( * ) Notice: Subject to any disclaimer, the term of this patent is extended or adjusted under 35 U.S.C. 154(b) by 0 days.

(21) Appl. No.: 11/488,739

(22) Filed: Jul. 19, 2006

(51) Int. Cl.
*H01R 24/00* (2006.01)

(52) U.S. Cl. ..... 439/630; 439/159; 439/638

(58) Field of Classification Search ..... 439/630, 439/638, 159, 945, 325; 361/737
See application file for complete search history.

(56) References Cited

U.S. PATENT DOCUMENTS 6,721,186 B2 * 4/2004 Yang ..... 361/737
6,932,652 B1 * 8/2005 Chen ..... 439/630
6,969,281 B2 * 11/2005 Lai ..... 439/630
7,033,223 B1 * 4/2006 Lin ..... 439/630
7,052,295 B1 * 5/2006 Lin ..... 439/159

* cited by examiner

*Primary Examiner*—Michael C. Zarroli
(74) *Attorney, Agent, or Firm*—Troxell Law Office, PLLC

(57) ABSTRACT

The present invention provides a card adapter that includes an upper cover, a lower cover and a set of converter terminals. The upper cover has an external form designed to conform to short memory card (MS DUO) specifications, and an insertion slot is defined at a rear end of the upper cover corresponding to the shape of a memory stick micro card (M2). The lower iron piece coated inner side with a layer of insulating coating, is inserted and joined to a rear portion of the lower cover. The converter terminals are singly fixed within a fixed seating by embedding molding means and extend outward to contact cards. Such a structural configuration enables converting a memory stick micro card of relatively small size into a short memory card of relatively larger size to facilitate inserting into a digital product provided with a short memory card circuit port.

4 Claims, 5 Drawing Sheets

CARD ADAPTER

BACKGROUND OF THE INVENTION (a) Field of the Invention

The present invention relates to a card adapter, and more particularly to a card adapter that uses an assembled configuration including an upper cover, a lower cover and a set of converter terminals to enable converting a memory stick micro card of relatively small size into a short memory card of relatively larger size that can be inserted into a digital product having a short memory card circuit port for use thereof. Hence, the present invention has the effectiveness of providing a structure that can be simply and quickly assembled, enables solid emplacement of component members, has superior earthing, saves on costs, prevents short-circuiting, prevents electromagnetic interference and is convenient to use, and is applicable for use in a variety of card adaptors or similar structures.

(b) Description of the Prior Art

The current popularity of 3C (computer, communications and consumer electronics) digital products, such as digital cameras, PDAs (personal digital assistants), MP3 (media player) personal stereos, have driven the vigorous development of flash memory cards and the derivation of a variety of memory cards having different size, form and specifications. The current most common memory card specifications include SM (Smart Media), xD-Picture Card, CF (Compact Flash), MD (Micro Drive), MS (Memory Stick) and SD (Secure Digital), MMC (Multi Media Card), and so on. However, with the increasing miniaturization of 3C digital products, manufacturers have released mini memory cards having substantially smaller size specifications, including the MS and MS PRO (Memory Stick PRO) extended Duo series, and the extended miniSD, RS-MMC (Reduced Size Multi Media Card) and Transflash derived from the SD and MMC specifications. The Transflash card, however, is still the smallest memory card in the current market, and the MS and MS PRO camps are actively promoting a micro memory card (Memory Stick Micro, M2) similar to that of the Transflash card. Nevertheless, continuous miniaturization of memory cards occupies a small area of the core market, and size of each type of memory card having different structural form and specifications differs or configuration of circuit port contact points varies.

Referring to FIG. 1, which shows a circuit port of a current memory stick micro card (M2) a provided with eleven gold contact points a1 and a circuit port of a short memory card (MS DUO) b configured with ten gold contact points b1, one less than the micro memory card (M2), wherein a first and second gold contact point a1 of the memory stick micro card (M2) a are temporarily non-functional, and a first and tenth gold contact point b1 of the short memory card (MS DUO) b are configured with the same function. Hence, the inventor of the present invention having accumulated years of experience in related arts, attentively and circumspectly carried out extensive study and exploration to ultimately design a new improved card adapter structure that facilitates converting the relatively small sized memory stick micro card (M2) into a relatively larger sized short memory card (MS DUO) to facilitate inserting into a digital product provided with a short memory card (MS DUO) circuit port for use thereof.

SUMMARY OF THE INVENTION

A primary objective of the present invention is to provide a card adapter that uses a structural assembly of an upper cover, a lower cover and a set of converter terminals to enable converting a memory stick micro card of relatively small size into a short memory card of relatively larger size to facilitate inserting into a digital product provided with a short memory card circuit port for use thereof, thus achieving effectiveness of providing a structure that can be simply and quickly assembled, enables solid emplacement of component members and is convenient to use, and substantially improving practicability and convenience of the entire configuration.

Another objective of the present invention is to provide the card adapter with a structural configuration that enables the lower cover formed by plastic injection molding to be mutually firmly joined to a lower iron piece, and an upper iron piece to be joined to an upper portion of the lower iron piece, thereby forming a secure card insertion space and a reinforced thin card adapter structure which improve practicability of the entire configuration.

Yet another objective of the present invention is to provide the card adapter with a structural configuration wherein each terminal of a set of converter terminals supersedes gold contact points of the traditional circuit board, thereby reducing quality control problems caused by multi-operation assembly, and providing a substantial saving on costs.

Yet another objective of the present invention is to provide the card adapter with an insulating coating coated on an inner side of the lower iron piece, which is able to prevent the gold contact points of the memory stick micro (M2) from coming in contact with the lower iron piece and short circuiting.

Yet another objective of the present invention is to provide the card adapter with a structural configuration that enables the upper iron piece and the lower iron piece to form an earth connection with the terminals, thereby achieving effectiveness of providing a good earth connection and preventing electromagnetic interference, which increase safety and practicability of the entire structural configuration.

In order to achieve the aforementioned objectives, the card adapter of the present invention comprises an upper cover, a lower cover and a set of converter terminals. The upper cover has an external form designed to conform to short memory card (MS DUO) specifications, and an insertion slot is defined at a rear end of the upper cover corresponding to the shape of a memory stick micro card (M2). Moreover, a positioning structure is located on a bottom surface of the upper cover. The lower cover has an external form designed to conform to short memory card (MS DUO) specifications, and a front end of the lower cover is configured with a short memory card (MS DUO) port. An opening is defined in a central portion of the lower cover, and a lower iron piece is inserted and joined to a rear portion of the lower cover. A layer of insulating coating is coated on an inner side of the lower iron piece, and a top portion of the lower iron piece is joined to an upper iron piece. Moreover, a positioning structure is located on edges of the lower cover corresponding to the upper cover. The set of converter terminals is configured with ten terminals, which are singly fixed within a fixed seating by embedding molding means. Ten electrical contact points extend outward towards the short memory card (MS DUO) port, and nine electrical contact points extend outward towards the memory stick micro card (M2) opening. Such a structural configuration enables converting a memory stick micro card of relatively small size into a short memory card of relatively larger size to facilitate inserting into a digital product provided with a short memory card circuit port for use thereof. Hence, the present invention has the effectiveness of providing a structure that can be simply and quickly assembled, enables solid emplacement of component members, has superior earthing, saves on costs, prevents short-circuiting, prevents electromagnetic interference and is convenient to use, which improve practicability, facilitation and safety of the entire structural configuration.

To enable a further understanding of said objectives and the technological methods of the invention herein, brief description of the drawings is provided below followed by detailed description of the preferred embodiments.

DETAILED DESCRIPTION OF THE PREFERRED EMBODIMENTS

Figure 1:
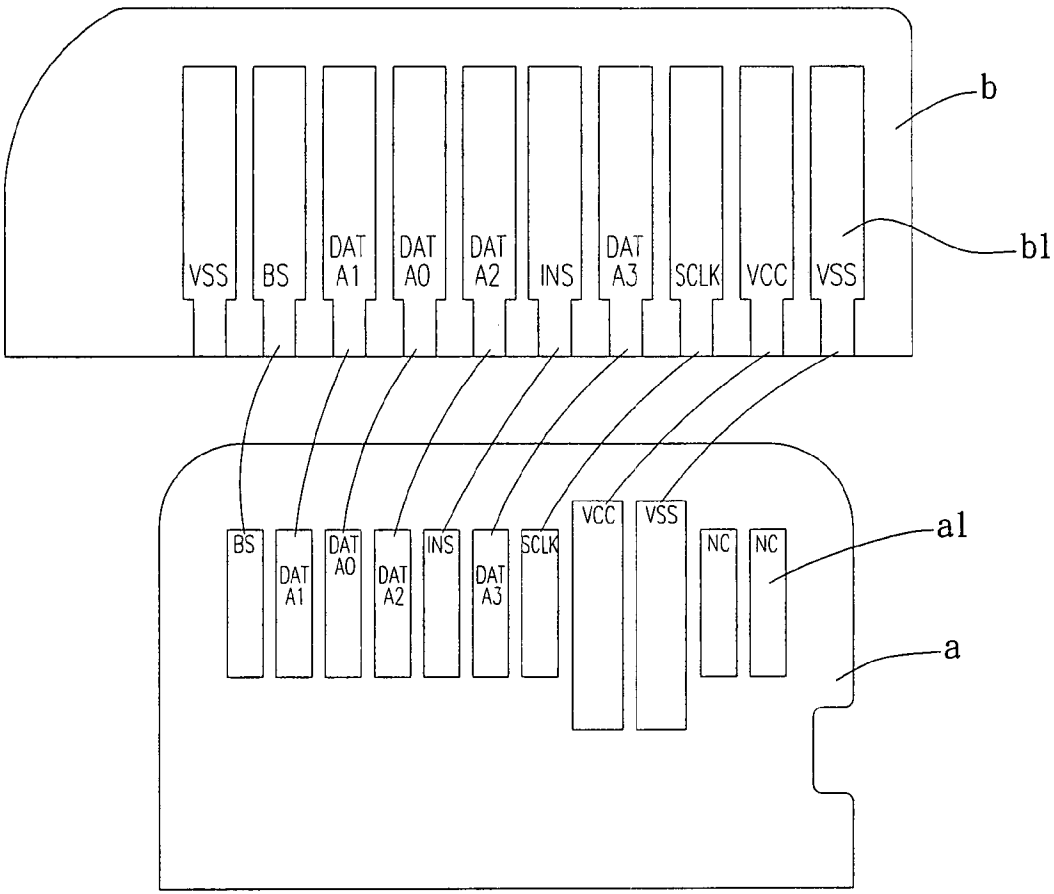
FIG. 1 Prior Art
FIG. 1 shows a schematic view depicting electrical connections between a memory stick micro card (M2) and a short memory card (MS DUO) of prior art.
Figure 2:
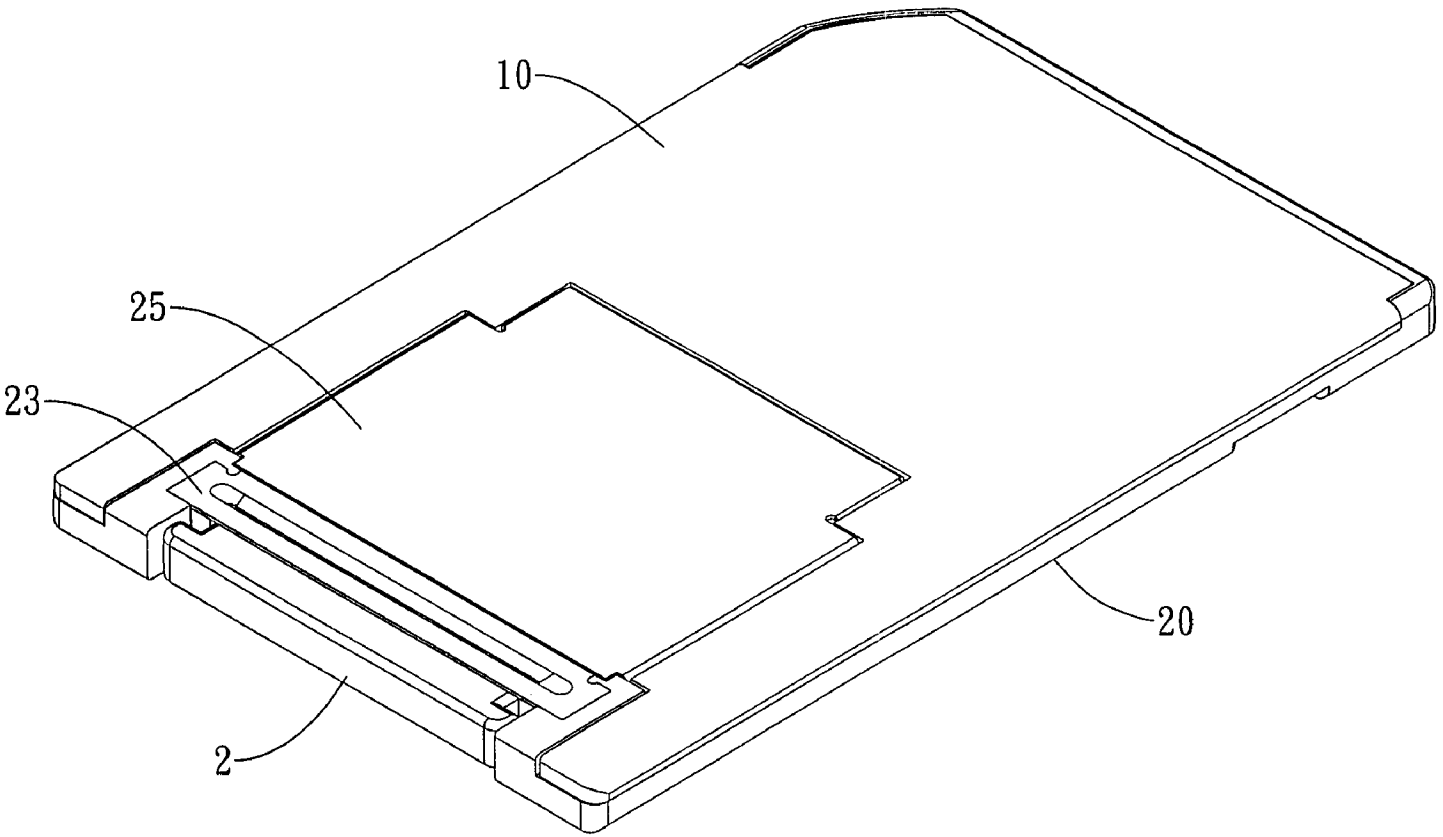
FIG. 2 shows an elevational view of an embodiment according to the present invention.
Figure 3:
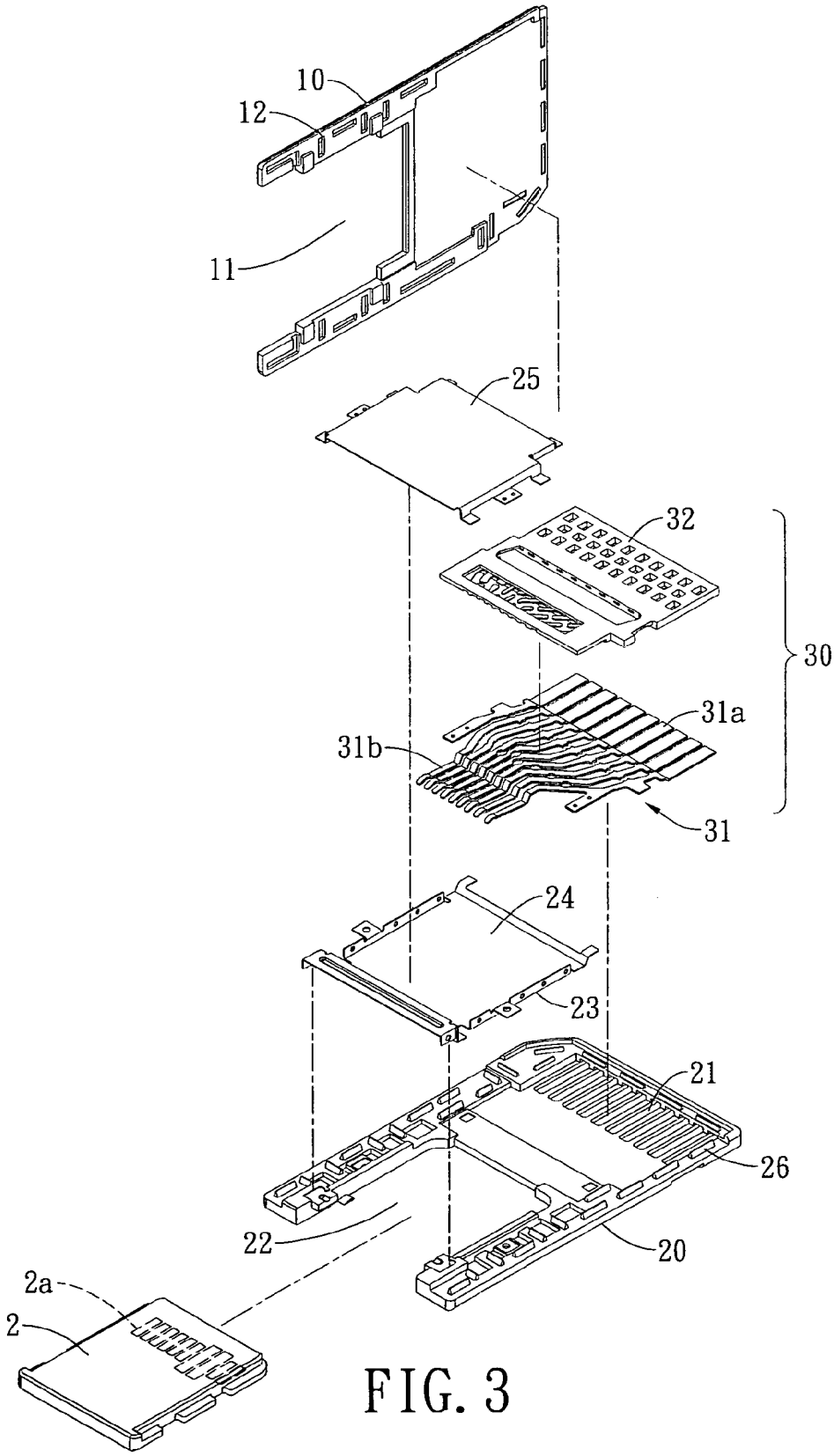
FIG. 3 shows an exploded elevational view of the embodiment according to the present invention.
Figure 4:
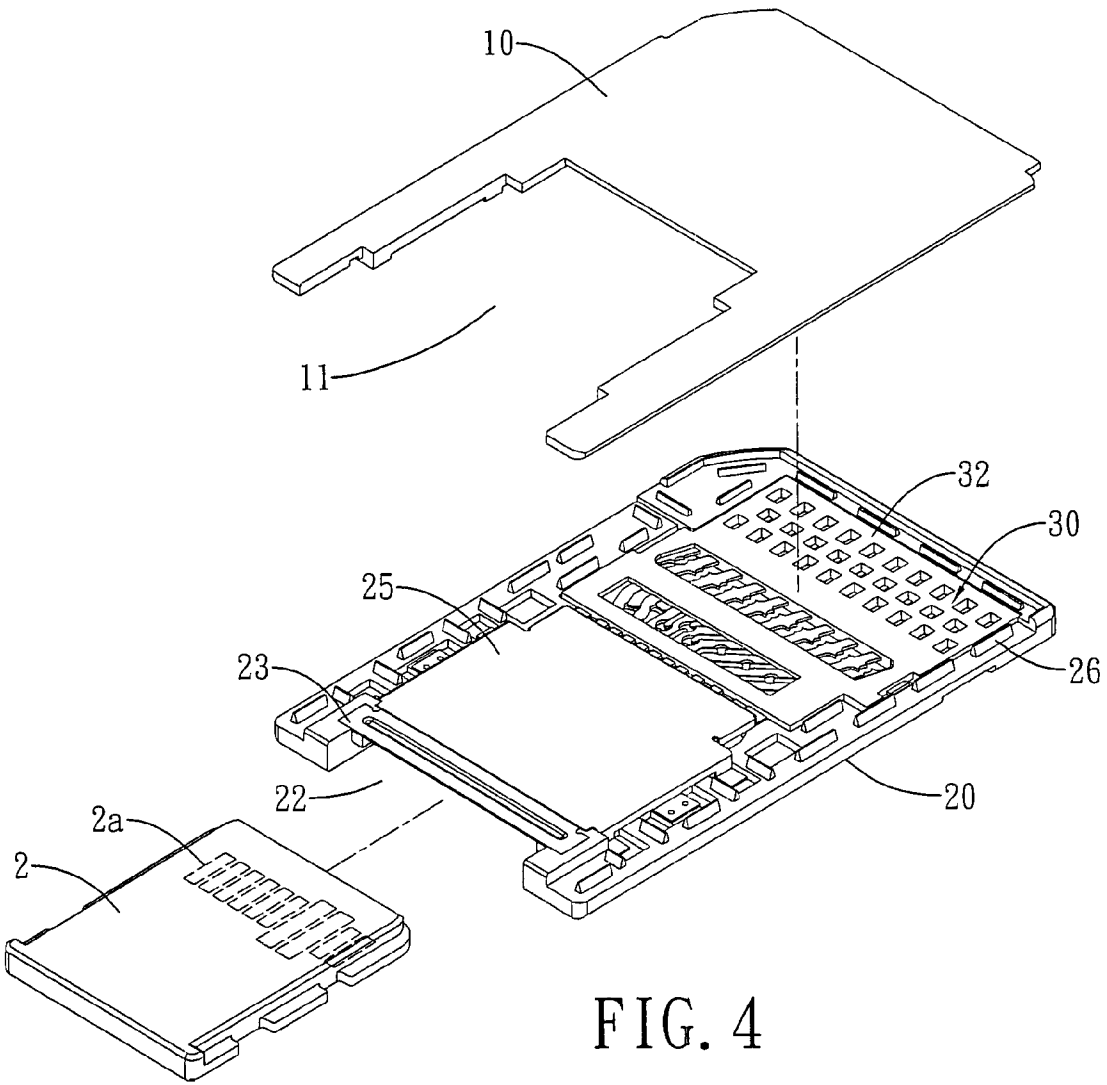
FIG. 4 shows a schematic view of the embodiment being combined with the memory stick micro (M2) according to the present invention.
Figure 5:
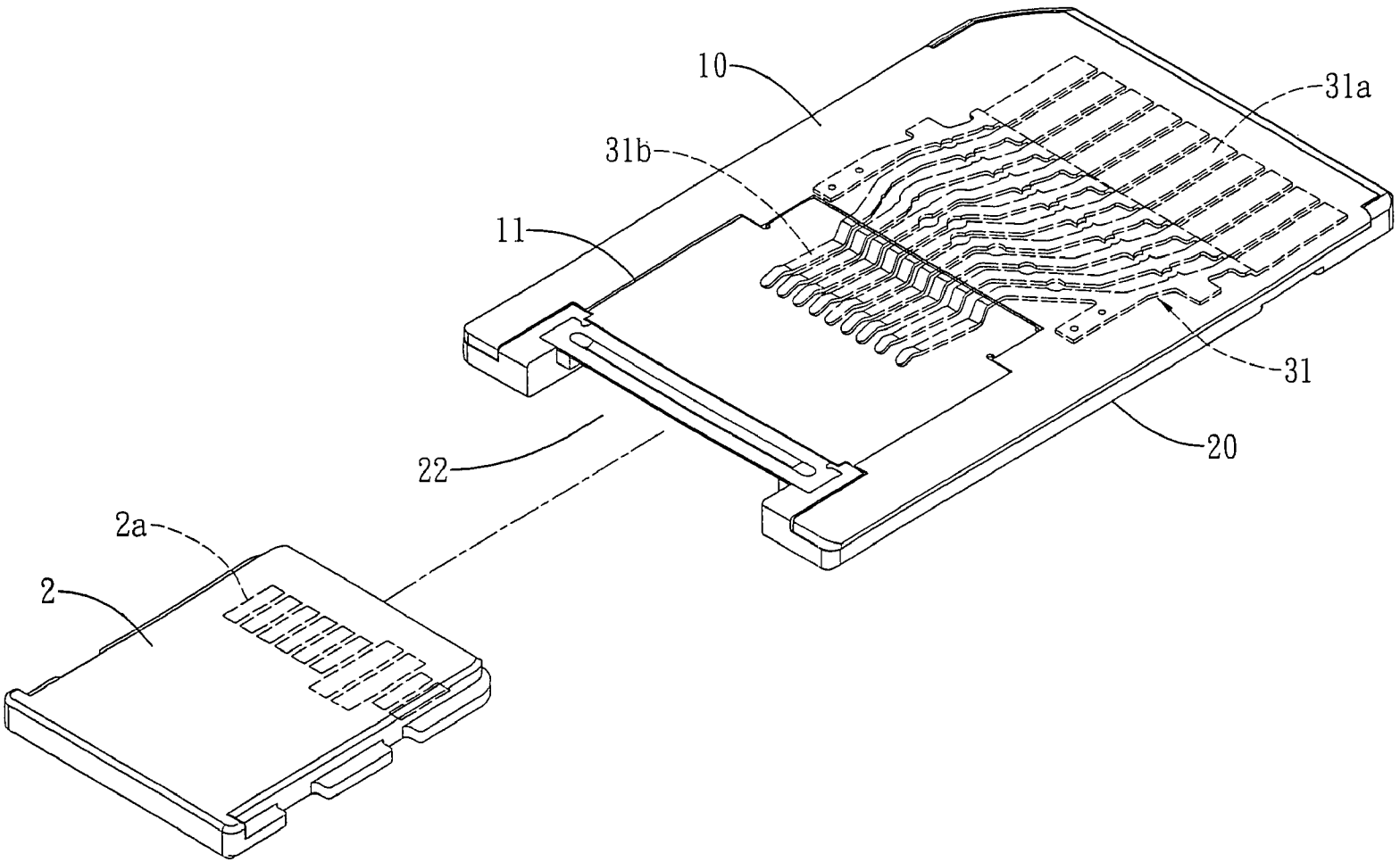
FIG. 5 shows a schematic view of the embodiment in use according to the present invention.

Referring to FIGS. 2, 3, 4 and 5, which show a card adapter of the present invention comprising:

An upper cover 10 having an external form designed to conform to short memory card (MS DUO) specifications. An insertion slot 11 is defined at a rear end of the upper cover 10 corresponding to the shape of a memory stick micro card (M2), and a positioning structure 12 is located on a bottom surface of the upper cover 10.

A lower cover 20 having an external form designed to conform to short memory card (MS DUO) specifications. A front end of the lower cover 20 is configured with a short memory card (MS DUO) port 21, and an opening 22 is defined in a central portion of the lower cover 20 to accommodate the memory stick micro card (M2) therein. A lower iron piece 23 is inserted and joined to a rear portion of the lower cover 20 (the lower cover 20 is formed by plastic injection molding and is mutually firmly joined to the lower iron piece 23). A layer of insulating coating 24 is coated on an inner side of the lower iron piece 23, and a top portion of the lower iron piece 23 is joined to an upper iron piece 25. Moreover, a positioning structure 26 is located on edges of the lower cover 20 corresponding to the upper cover 10.

A set of converter terminals 30 configured with ten terminals 31, which are singly fixed within a fixed seating 32 by embedding molding means. Ten electrical contact points 31 extend outward towards the short memory card (MS DUO) port 21, and nine electrical contact points 31*b* extend outward towards the memory stick micro card (M2) opening 22. The upper iron piece 25 forms an earth connection with the terminals 31.

According to the aforementioned structural configuration of the card adapter of the present invention, as depicted in FIGS. 2, 3, 4 and 5, the present invention is characterized in that structural assembly of the upper cover 10, the lower cover 20 and the set of converter terminals 30 enables the lower iron piece 23 to be mutually firmly joined to the plastic injection molded lower cover 20, and the upper iron piece joined to the upper portion of the lower iron piece 23 forms a secure card insertion space and a reinforced thin card adapter structural configuration. Moreover, the positioning structure 26 located on the edges of the lower cover 20 enables the corresponding positioning structure 12 of the upper cover 10 to be securely joined thereto. Each of the terminals 31 of the set of converter terminals 30 supersedes the gold contact points of a traditional circuit board, thereby reducing quality control problems caused by multi-operation assembly, and providing a substantial saving on costs. In addition, the insulating coating 24 coated on the inner side of the lower iron piece 23 effectively prevents gold contact points 2*a* of the memory stick micro (M2) from coming in contact with the lower iron piece 23 and short circuiting. Furthermore, the ten terminals 31 installed in the set of converter terminals 30 singly fixed within the fixed seating 32 by embedding molding means, the ten electrical contact points 31*a* extending outward towards the short memory card (MS DUO) port 21 and the nine electrical contact points 31*b* extending outwards toward the opening 22 of the memory stick micro (M2) enable achieving converting the memory stick micro card (M2) of relatively small size into the short memory card (MS DUO) of relatively larger size to facilitate inserting into a digital product provided with a short memory card (MS DUO) circuit port for use thereof. Moreover, the upper iron piece 25 and the lower iron piece 23 forming an earth connection with the terminals 31 enable achieving effectiveness of providing a good earthing and preventing electromagnetic interference. Hence, the present invention has the effectiveness of providing a structure that can be simply and quickly assembled, enables solid emplacement of component members, has superior earthing, saves on costs, prevents short-circuiting, prevents electromagnetic interference and is convenient to use, which improve practicability, facilitation and safety of the entire structural configuration.

According to the aforementioned detailed description, persons familiar with related art are able to easily understand that the present invention can clearly achieve the aforementioned objectives, and evidently complies with essential elements as required for a new patent application. Accordingly, a new patent application is proposed herein.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A card adapter comprising:

an upper cover having an external form designed to conform to short memory card (MS DUO) specifications, an insertion slot is defined at a rear end of the upper cover corresponding to the shape of a memory stick micro card (M2), and a positioning structure is located on a bottom surface of the upper cover;

a lower cover having an external form designed to conform to short memory card (MS DUO) specifications, a front end of the lower cover is configured with a short memory card (MS DUO) port, and an opening is defined in a central portion of the lower cover to accommodate a memory stick micro card (M2) therein, a lower iron piece is inserted and joined to a rear portion of the lower cover, a layer of insulating coating is coated on an inner side of the lower iron piece, and a top portion of the lower iron piece is joined to an upper iron piece, moreover, a positioning structure is located on edges of the lower cover corresponding to the upper cover; and a set of converter terminals configured with ten terminals, which are singly fixed within a fixed seating by embedding molding means, ten electrical contact points extend outward towards the short memory card (MS DUO) port, and nine electrical contact points extend outward towards the memory stick micro card (M2) opening;

whereby the memory stick micro card (M2) of relatively small size can be converted to the short memory card (MS DUO) of relatively larger size, thereby facilitating inserting into a digital product provided with a short memory card (MS DUO) circuit port for use thereof.

2. The card adapter according to claim 1, wherein the upper iron piece forms an earth connection with the terminals.

3. The card adapter according to claim 1, wherein the lower iron piece forms an earth connection with the terminals.

4. The card adapter according to claim 1, wherein the lower cover is formed by means of plastic injection molding, and is mutually firmly joined to the lower iron piece.

* * * * *